US009498068B2

(12) United States Patent
Lee

(10) Patent No.: US 9,498,068 B2
(45) Date of Patent: Nov. 22, 2016

(54) MASSAGE MODULE THAT FITS INTO A CAVITY OF A DECOMPRESSED FOAM MATTRESS

(75) Inventor: Youn Jae Lee, Pleasanton, CA (US)

(73) Assignee: Zinus, Inc., San Leandro, CA (US)

( * ) Notice: Subject to any disclaimer, the term of this patent is extended or adjusted under 35 U.S.C. 154(b) by 1173 days.

(21) Appl. No.: 12/930,330

(22) Filed: Jan. 3, 2011

(65) Prior Publication Data

US 2012/0167311 A1 Jul. 5, 2012

(51) Int. Cl.
*A47C 17/86* (2006.01)

(52) U.S. Cl.
CPC ..... *A47C 17/86* (2013.01)

(58) Field of Classification Search
CPC ..... A47C 17/86
USPC ..... 5/915, 933, 694
See application file for complete search history.

(56) References Cited

U.S. PATENT DOCUMENTS

| | | | | | |
|---|---|---|---|---|---|
| 4,326,506 | A | * | 4/1982 | Kawabata | 601/57 |
| 4,969,451 | A | | 11/1990 | Totten | 128/33 |
| 5,007,410 | A | * | 4/1991 | DeLaney | 601/53 |
| 5,020,518 | A | | 6/1991 | Spears et al. | 128/52 |
| 5,327,598 | A | | 7/1994 | Liou | 5/481 |
| 5,437,608 | A | * | 8/1995 | Cutler | 601/49 |
| 5,600,214 | A | | 2/1997 | Fromson | 318/120 |
| 5,740,568 | A | | 4/1998 | Elliot | 5/620 |
| 5,787,528 | A | | 8/1998 | Antinori | 5/616 |
| 6,053,880 | A | * | 4/2000 | Sleichter, III | 601/57 |
| 6,101,647 | A | | 8/2000 | Stroud et al. | 5/618 |
| 6,106,576 | A | | 8/2000 | Fromson | 818/16 |
| 6,178,577 | B1 | | 1/2001 | Chien-Chuan | 5/694 |
| 6,224,563 | B1 | | 5/2001 | Nonoue et al. | 601/99 |
| 6,363,559 | B1 | | 4/2002 | Saxon | 5/694 |
| 6,396,224 | B1 | | 5/2002 | Luff et al. | 318/16 |
| 6,502,264 | B1 | | 1/2003 | Clothier et al. | 5/915 |
| 6,684,423 | B2 | * | 2/2004 | Godette | 5/600 |
| 6,754,922 | B2 | | 6/2004 | Dewert | 5/617 |
| 6,832,991 | B1 | | 12/2004 | Inada et al. | 601/99 |
| 7,160,260 | B2 | | 1/2007 | Hsiao | 601/49 |
| 7,322,058 | B2 | | 1/2008 | Long | 5/600 |
| 7,454,805 | B2 | | 11/2008 | Osborne et al. | 5/618 |
| 7,591,035 | B2 | | 9/2009 | Guo | 5/600 |

* cited by examiner

*Primary Examiner* — Fredrick Conley
(74) *Attorney, Agent, or Firm* — Imperium Patent Works; Darien K. Wallace

(57) ABSTRACT

Removable massage modules provide a mattress with a massage function. The mattress is compressed and shipped in a packing box with the massage modules separate from the mattress. The end customer then inserts the massage modules. The mattress has a bottom foam layer with cavities whose walls are perpendicular to the outer surface of the foam layer. Each massage module includes a massage motor encased in molded foam. The molded foam is attached to a foam section with cylindrical holes that pass from an outer side to the molded foam and allow hot air to escape the massage motor. The top and bottom sides of each massage module have the shape formed by the walls of the cavities. The massage modules are connected by power cords to a module controller that receives RF signals from a remote control device. The massage modules can also be inserted into a mattress topper.

21 Claims, 8 Drawing Sheets

MASSAGE MODULE THAT FITS INTO A CAVITY OF A DECOMPRESSED FOAM MATTRESS

TECHNICAL FIELD

The present invention relates to a mattress that produces a massage effect, and in particular to a mattress with removable massage modules.

BACKGROUND INFORMATION

Beds that have a massage function have conventionally been high priced, complex structures. For example, adjustable beds used in hospitals and convalescent centers sometimes produce a massage effect using motors that are attached to the frame of the bed. Beds used in homes sometimes have massage motors built into the furniture. And massage motors can even be built into the mattress portion of the bed. In each of these situations, when the massage mechanism becomes damaged, the entire complex structure must be serviced. The bed may be shipped back to the manufacturer for repair or a service technician may visit the user and remove or repair the massage mechanism.

A less complex and expensive way is sought to impart a massage effect to a bed that does not require maintenance to be provided by a service technician or by shipping the bed back to the manufacturer.

SUMMARY

A mattress is provided with a massage effect by massage modules that are inserted into the mattress after shipping. The massage modules are shipped outside of the mattress, which is compressed and rolled and placed in a packing box that is much smaller than a box that would contain an uncompressed mattress. The end customer then decompresses the mattress and inserts the massage modules. The mattress has a bottom foam layer with cavities whose walls are perpendicular to the outer surface of the foam layer. The outer side of an inserted massage module is coplanar with the outer surface of the foam layer. The outer surface of the foam layer is the bottom surface of a three-layer foam mattress. The bottom and middle layers are made of high-density polyurethane foam (HD foam), whereas the top layer is made of visco-elastic polyurethane foam (memory foam).

For a queen size mattress, there are three massage modules on the right side and three massage modules on the left side of the mattress. Each massage module includes a massage motor encased in molded HD foam. The molded foam is attached to a foam section having cylindrical holes that pass from an outer side of the foam section to the molded foam. The holes allow hot air to escape from the massage motor. The top and bottom sides of each massage module have the shape formed by the walls of the cavities. The three massage modules on each side of the mattress are connected by power cords to a module controller that is plugged into wall current. Each module controller receives RF signals from remote control devices that control the strength of vibration of the massage motors as well as the massage style provided by the three connected massage modules. The massage modules can also be inserted into cavities in a decompressed mattress topper to provide a massage function.

A method of manufacturing a bedding article with a massage function provided by removable massage modules includes forming cavities in a bottom foam layer and forming massage modules having massage motors encased in molded foam. The bottom, middle and top foam layers of a mattress or mattress topper are first formed. Then cavities are formed in the bottom foam layer having walls that are perpendicular to the outer surface of the bottom foam layer. Each cavity opens through a hole in the outer surface that has the shape formed by the walls of the cavity.

The top side and bottom side of each massage module has the shape formed by the walls of the cavity. A massage motor is place on a foam section, and the molded foam is poured in a mold over the massage motor. The foam section has a plurality of cylindrical holes that are orthogonal to the top and bottom sides of the foam section. When the mattress is assembled and the massage function is used, hot air generated by an electric motor exits holes or slots in a base plate of each massage motor and travels through the cylindrical holes in the foam section to exit out of the bottom of the mattress. During the manufacturing steps, massage motors of three massage modules are connected via power cords to a module controller. The mattress or mattress topper is compressed, folded and rolled and placed in a packing box. The massage modules, module controllers and remote control devices are placed in the packing box separate from the compressed mattress or topper. Alternatively, the massage modules, controllers and remote controls are shipped in a separate packing box. The end customer then decompresses the mattress or topper and inserts the massage modules and module controllers into the cavities in the bottom foam layer of the mattress or topper.

A bedding article with a massage function provided by removable massage modules includes a massage module, a foam layer, and means for receiving the massage module into the foam layer. The means exhibits the shape of a side of the massage module. The means has walls that are perpendicular to the outer surface of the foam layer, and the walls form the shape of the side of the massage module. In one embodiment, the outer surface of the foam layer is the bottom surface of a three-layer foam mattress.

Further details and embodiments are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Figure 1:
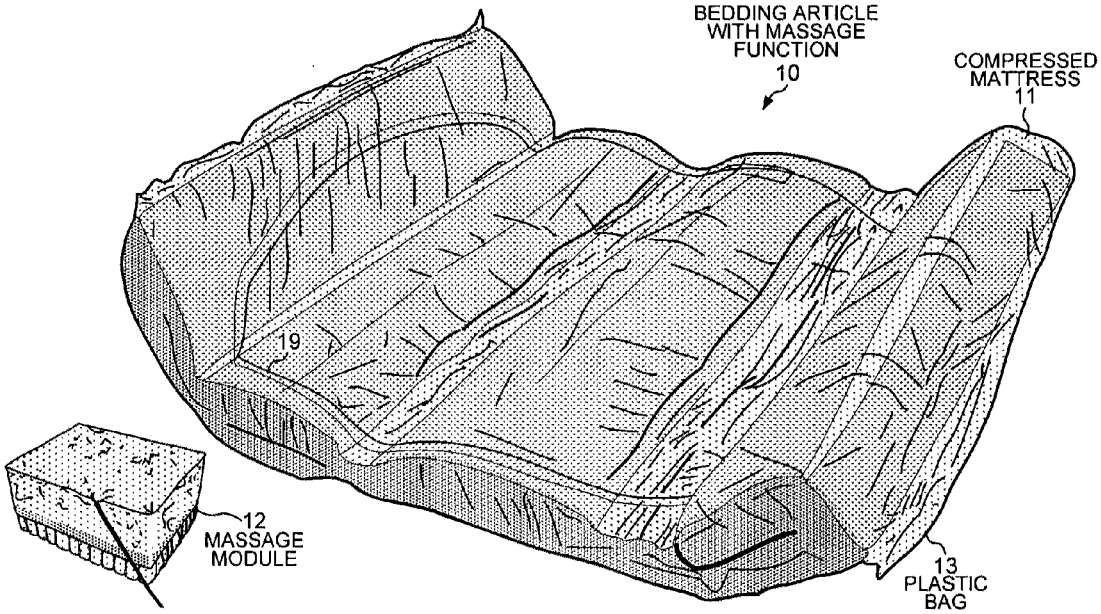
FIG. 1 is a perspective view of a novel bedding article including a compressed mattress and a removable massage module.

FIG. 1 shows a novel bedding article 10 with a massage function provided by removable massage modules. Bedding article 10 includes a foam mattress 11, several massage modules 12, a module controller, an outer mattress cover and a remote control device. In one embodiment, mattress 11 is a queen size mattress, and there are six massage modules, two module controllers and two remote control devices. One of the six massage modules 12 is shown in FIG. 1. In one implementation, the mattress, modules and controllers are shipped together in a packing box to the end customer. In another implementation, the mattress, modules and controllers are shipped together, but in two separate boxes: one for the mattress and another for the massage modules and the module controllers. Foam mattress 11 is compressed before shipping and sealed in an air-tight plastic bag 13. In this way, a packing box with a smaller volume can be used for the mattress. A packing box containing a fully compressed, folded and rolled foam mattress has less than a quarter of the volume of a packing box containing a regular uncompressed foam mattress. Consequently, more than four times as many boxes of compressed mattresses fit into a shipping container than do boxes of uncompressed mattresses. In addition, the smaller boxes of compressed mattresses can fill in the remaining spaces in a shipping container that cannot accommodate entire boxes of uncompressed mattresses. Thus, shipping boxes of compressed mattresses is less expensive than shipping uncompressed mattresses because more boxes of compressed mattresses can fit in a shipping container.

A mattress with built-in massage motors cannot, however, be fully compressed. The massage motors cannot be compressed, and the foam immediately adjacent to the motors also does not compress. Thus, shipping mattresses with massage mechanisms that cannot be removed is more expensive than shipping the novel bedding article 10. FIG. 1 shows compressed mattress 11 just after being removed from the packing box. After being compressed, mattress 11 was folded into five sections, and the sections were rolled up over one another. In FIG. 1, the first and second sections have not yet been unfolded. Moreover, air-tight plastic bag 13 has not yet been ruptured in FIG. 1. After the end of the plastic bag 13 is slit open, air rushes into the bag, and the foam of mattress 11 begins to expand to its normal uncompressed condition. Although mattress 11 expands to more than eighty percent of its regular height within the first minute, it can take twenty-four hours for air to enter all of the open cells of the foam.

Figure 2:
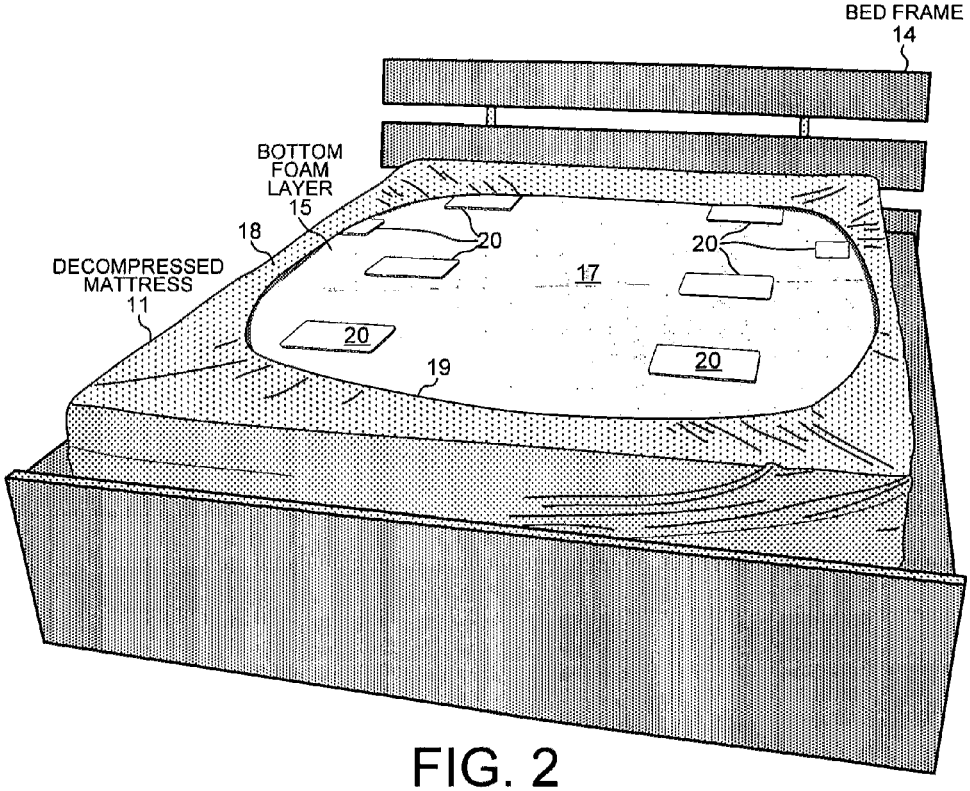
FIG. 2 is a perspective view of the mattress of FIG. 1 after being decompressed.

FIG. 2 shows mattress 11 after the foam has decompressed for a few minutes. Plastic bag 13 has been removed from mattress 11, and mattress 11 has been placed upside down on a bed frame 14. In one embodiment, mattress 11 has three foam layers: a bottom foam layer 15 of high-density polyurethane foam (HD foam), a middle foam layer 16 of HD foam (shown in FIG. 3), and a top foam layer of visco-elastic polyurethane foam (memory foam). The bottom outer surface 17 of bottom foam layer 15 is visible in FIG. 2. Mattress 11 is covered by a mattress cover 18 of thin cloth pulled taut by an elastic band 19. Mattress cover 18 is placed over mattress 11 before the mattress is compressed and is delivered along with mattress 11 inside plastic bag 13.

FIG. 2 shows that bottom foam layer 15 has eight cavities filled with eight foam plugs 20. In FIG. 2, the foam plugs 20 protrude somewhat from the bottom outer surface 17 of bottom foam layer 15. In the manufacturing process, the foam plugs 20 are cut out of bottom foam layer 15 and are then reinserted into the resulting cavities. Thus, the foam plugs 20 are made of the same material as bottom foam layer 15. The foam plugs 20 are cut out of bottom foam layer 15 before bottom foam layer 15 is glued or laminated to middle foam layer 16. Then after bottom layer 15 is glued or laminated to middle layer 16, the foam plugs are placed back into the cavities. The six larger foam plugs 20 fill cavities that will later receive the massage modules 12. The two smaller foam plugs 20 fill cavities that will contain the module controllers. After mattress 11 is placed upside down on bed frame 14, the eight foam plugs 20 are removed from the cavities in bottom foam layer 15.

Figure 3:
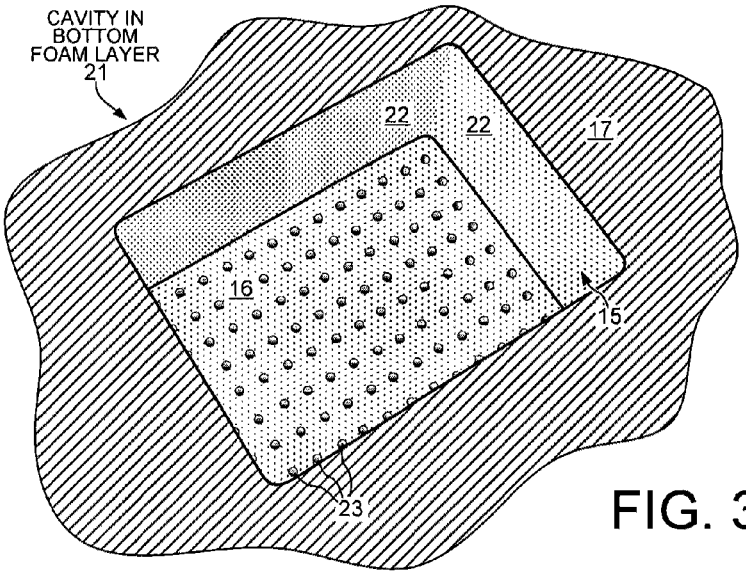
FIG. 3 is a perspective view of a cavity in a bottom foam layer after a foam plug has been removed and before a massage module has been inserted.

FIG. 3 shows one of the larger cavities 21 after the foam plug 20 has been removed and before a massage module 12 has been inserted. Cavity 21 in foam layer 15 has walls 22 that are perpendicular to outer surface 17. Walls 22 of cavity 21 form a shape, in this case a rectangle. Cavity 21 opens through a hole in outer surface 17 that also has the same rectangular shape. Two of the six sides of both the foam plug 20 and the massage module 12 that fit inside cavity 21 also have the same shape. Cavity 21 is a means for receiving massage module 12 into foam layer 15. In the embodiment of FIG. 3, middle foam layer 16 has a plurality of cylindrical holes 23 that are orthogonal to the surface of layer 16 that is visible in FIG. 3. The holes provide a means for the heat generated by the massage motor in massage module 12 to travel away from the massage module.

Figure 4:
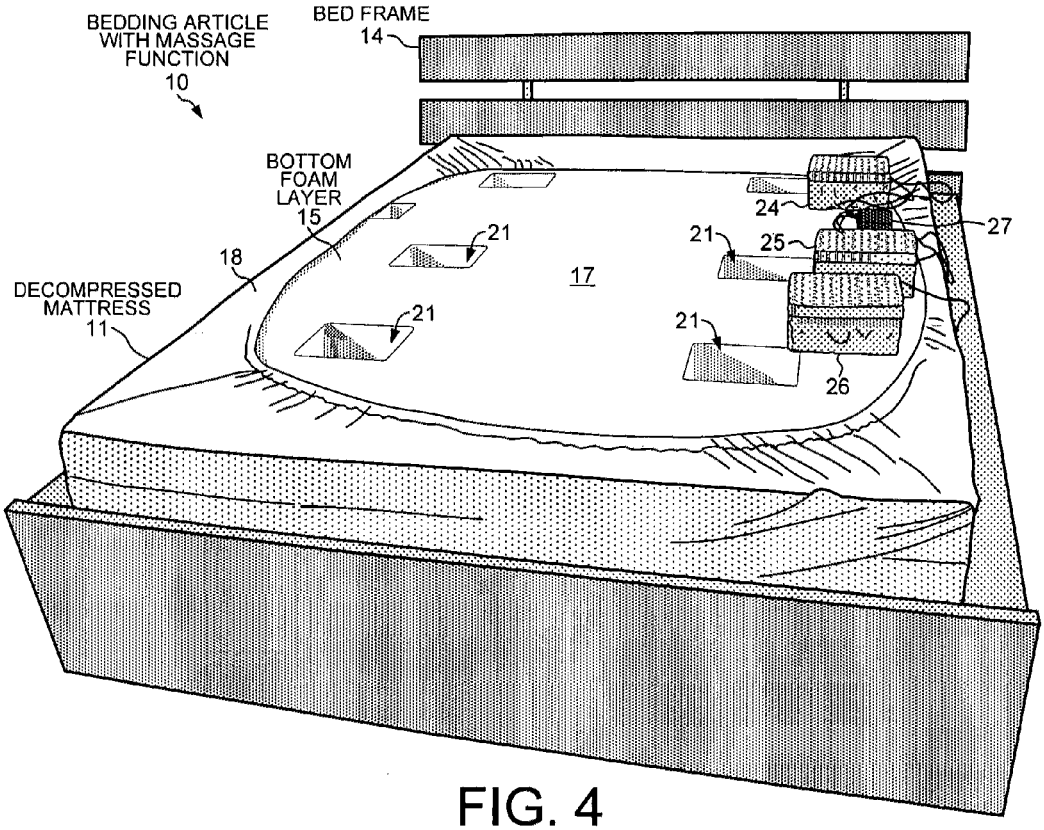
FIG. 4 is a perspective view of the mattress of FIG. 2 placed upside down on a bed frame with foam plugs removed from the cavities.

FIG. 4 shows mattress 11 placed upside down on bed frame 14 with the foam plugs 20 removed from the cavities 21. Three massage modules 24-26 and a module controller 27 are sitting on outer surface 17 of bottom foam layer 15. Bedding article 10 includes three massage modules on each side of queen size mattress 11. The three massage modules 24-26 will occupy the cavities 21 that are on the left side of mattress 11 when the mattress is flipped right side up with outer surface 17 of bottom foam layer 15 facing downward. The three massage modules 24-26 are controlled by module controller 27. Module controller 27 turns each massage motor on and off and controls the speed at which each massage motor vibrates. Module controller 27 in turn is controlled by a remote control device that communicates with controller 27 via radio frequency (RF) signals. A power cord connects each of massage modules 24-26 to module controller 27, which in turn is connected by a power cable to a wall outlet. Module controller 27 also has an antenna cable for receiving RF control signals from the remote control device.

Figure 5:
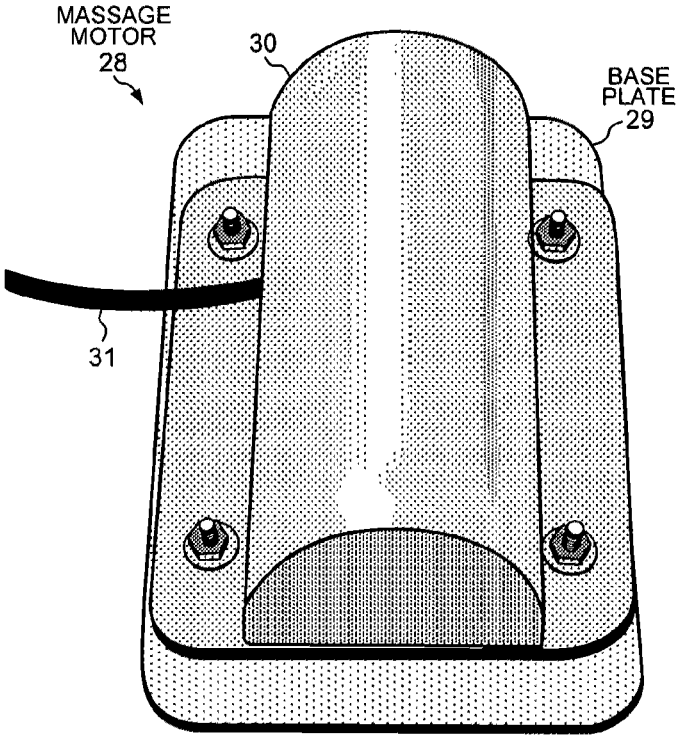
FIG. 5 is a perspective view of a massage motor that is part of the massage module of FIG. 1.

FIG. 5 shows a massage motor 28 that is part of each massage module 12. Massage motor 28 includes an electric motor that is mounted on a base plate 29 and covered by a motor housing 30. The electric motor turns and vibrates in response to a current supplied from module controller 27 through a power cord 31. Slots or holes are drilled through base plate 29 beneath the electric motor to allow hot air generated by the operating motor to escape.

Figure 6:
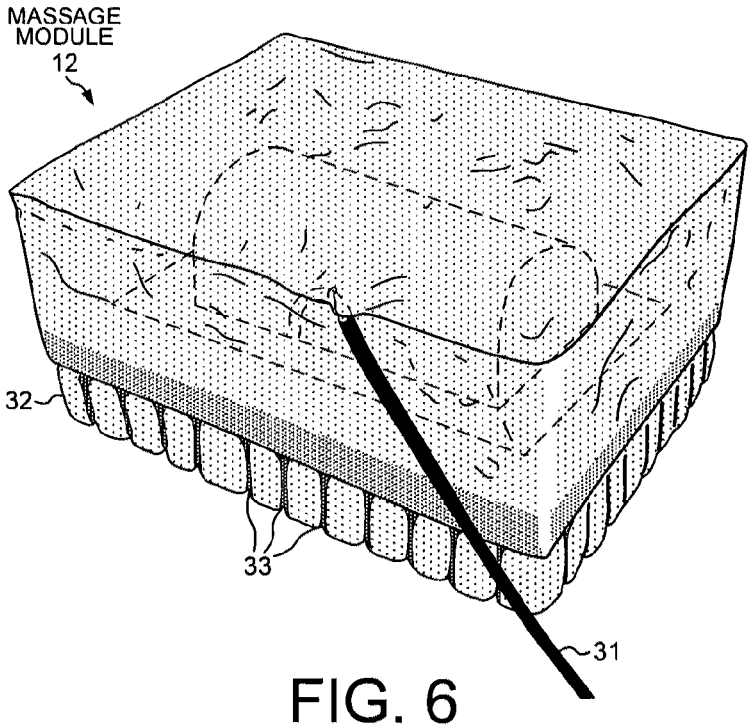
FIG. 6 is a more detailed view of the massage module of FIG. 1.

FIG. 6 shows a massage module 12 in more detail. Each massage module 12 is made by molding foam over massage motor 28. A section of cut foam 32 with the rectangular shape of cavity 21 is first placed in the bottom of a mold. The mold has the same shape as cavity 21. Vertical, cylindrical holes 33 have beforehand been stamped throughout the section of foam. Base plate 29 is placed on the section of foam 32, as indicated by the dashed outline of massage motor 28 inside the massage module 12 shown in FIG. 6. Then liquid polyol foam raw materials are poured into the mold over massage motor 28, and the lid of the mold is closed. The molded foam is allowed to set up. The molded foam sticks to the inside surface of the piece of cut foam 32, and some of the liquid foam reactants flow partially into the vertical holes 33 outside of the area covered by base plate 29. When massage module 12 is removed from the mold, the massage motor is encased in molded foam above the piece of cut foam 32. The top and bottom sides of massage module 12 have the shape formed by the walls of cavity 21. The slots or holes in base plate 29 are positioned over some of the vertical holes 33 in the section of cut foam 32. Thus, hot air from around the electric motor can escape through the slots in base plate 29 and through the holes in the section of cut foam 32. Massage motor 28 does not overheat because hot air generated by the electric motor exits out of the bottom of mattress 11 and because module controller 27 is programmed to turn off the electric motor after a predetermined period of use. For example, module controller 27 turns off each massage motor 28 after fifteen minutes of continued use.

Figure 7:
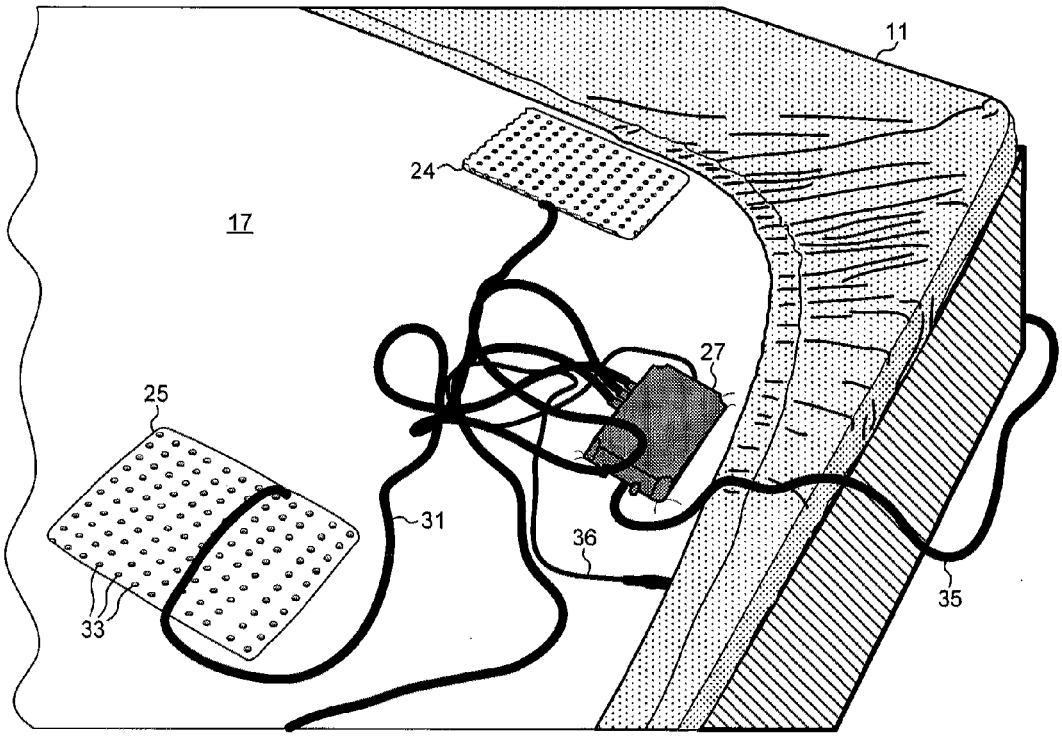
FIG. 7 shows massage modules that have been inserted into cavities in the bottom foam layer shown in FIG. 4.

FIG. 7 shows massage modules 24-25 that have been inserted into the cavities 21 in bottom foam layer 15. The massage modules are inserted into the cavities 21 until the outer side of the piece of cut foam 32 is level with outer surface 17 of bottom foam layer 15. Mattress 11 in FIG. 7 is still upside down. After mattress 11 is later flipped right-side up, the massage modules 24-25 have the orientation of massage module 12 shown in FIG. 6 with the piece of cut foam 32 on the bottom. Hot air generated by the electric motors of the massage module 24-25 escapes out of the bottom of mattress 11 through holes 33. Module controller 27 shown in FIG. 7 is in the process of being inserted down into a smaller cavity 21 in bottom foam layer 15. A smaller piece of cut foam 34 with through holes 33 is then inserted into the smaller cavity 21 over module controller 27 leaving cords and cables to protrude from between the cut foam 34 and bottom foam layer 15. Module controller 27 is connected by a power cord 31 to each of the three massage modules 24-26. A power cable 35 connects module controller 27 to line current from a wall socket. An antenna cable 36 is also connected to module controller 27 and protrudes from the smaller cavity 21.

Figure 8:
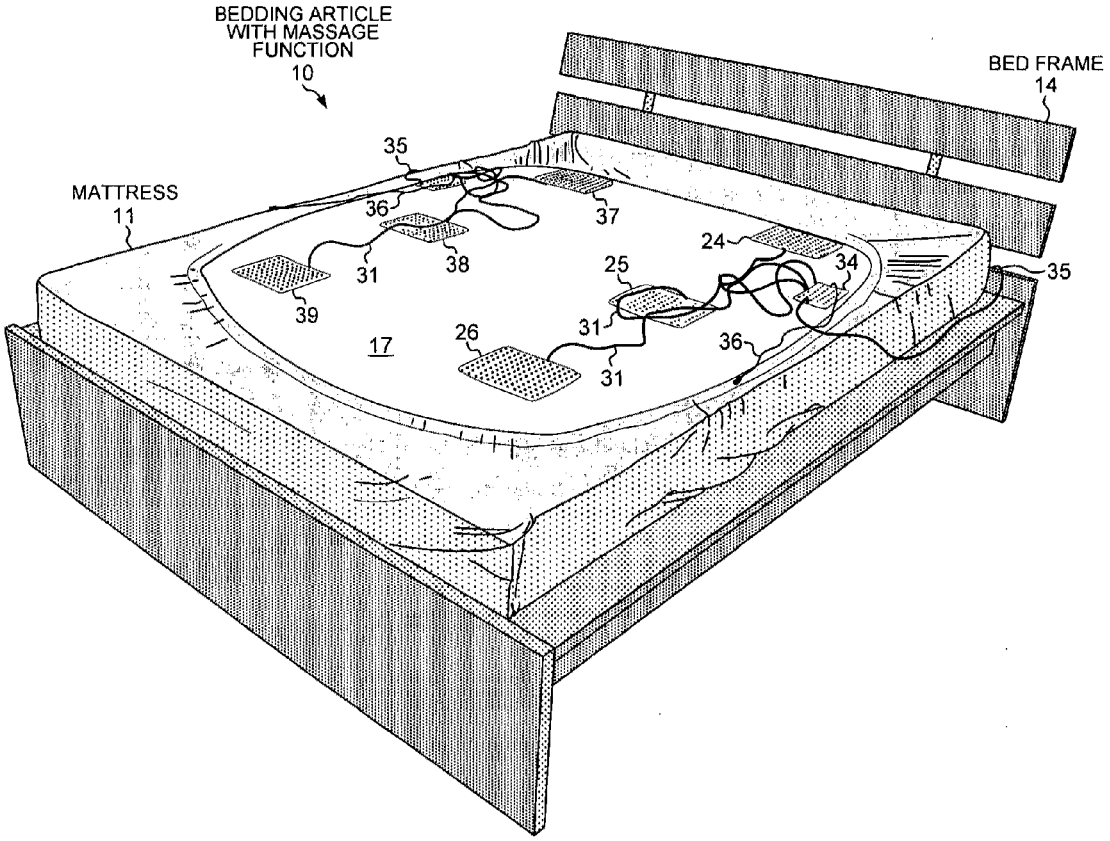
FIG. 8 is a perspective view of the bottom of the mattress of FIG. 2 with six massage modules and two module controllers inserted into the cavities in the bottom foam layer.

FIG. 8 shows the entire bottom of mattress 11 with six massage modules and two module controllers inserted into cavities 21 in bottom foam layer 15. The massage modules 24-26 occupy the positions indicated on a first remote control device as 1, 2 and 3, respectively. A second remote control device controls the massage modules 37-39 that will be positioned under the right side of mattress 11 when the mattress is flipped right side up. The power cables 35 should not be plugged into wall sockets until after the mattress has been flipped right side up because the closest wall socket will probably be different once the mattress is flipped. An electrical adapter "brick" is provided at the end of each power cable 35 to adapt the 120V AC wall current to the current and voltage required by the electric motors.

Figure 9:
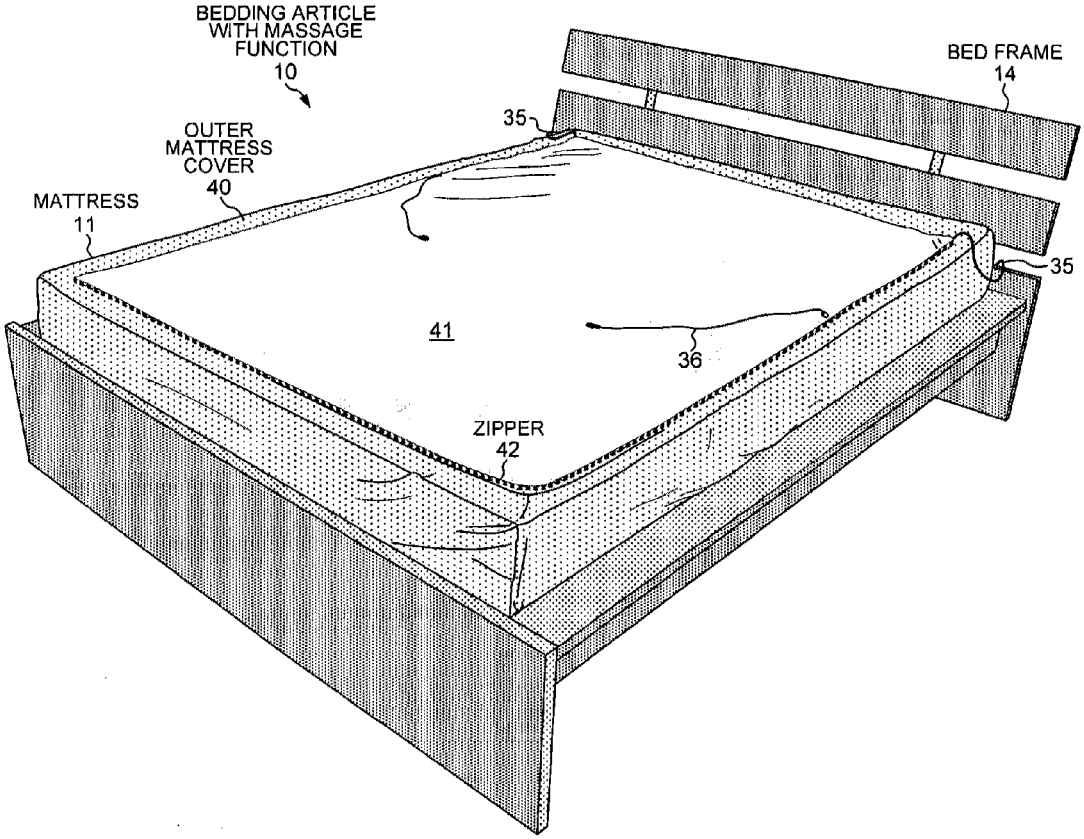
FIG. 9 shows the mattress of FIG. 8 after an outer mattress cover has been pulled over the mattress.

FIG. 9 shows mattress 11 of FIG. 8 after an outer mattress cover 40 has been pulled over thin mattress cover 18. Outer mattress cover 40 has a bottom flap 41 that is closed by a zipper 42. Antenna cables 36 pass through grommet rings at the edges of bottom flap 41. When mattress 11 is flipped right side up, the antenna cables 36 hang down under bed frame 14 or lie on a box spring beneath mattress 11.

Figure 10:
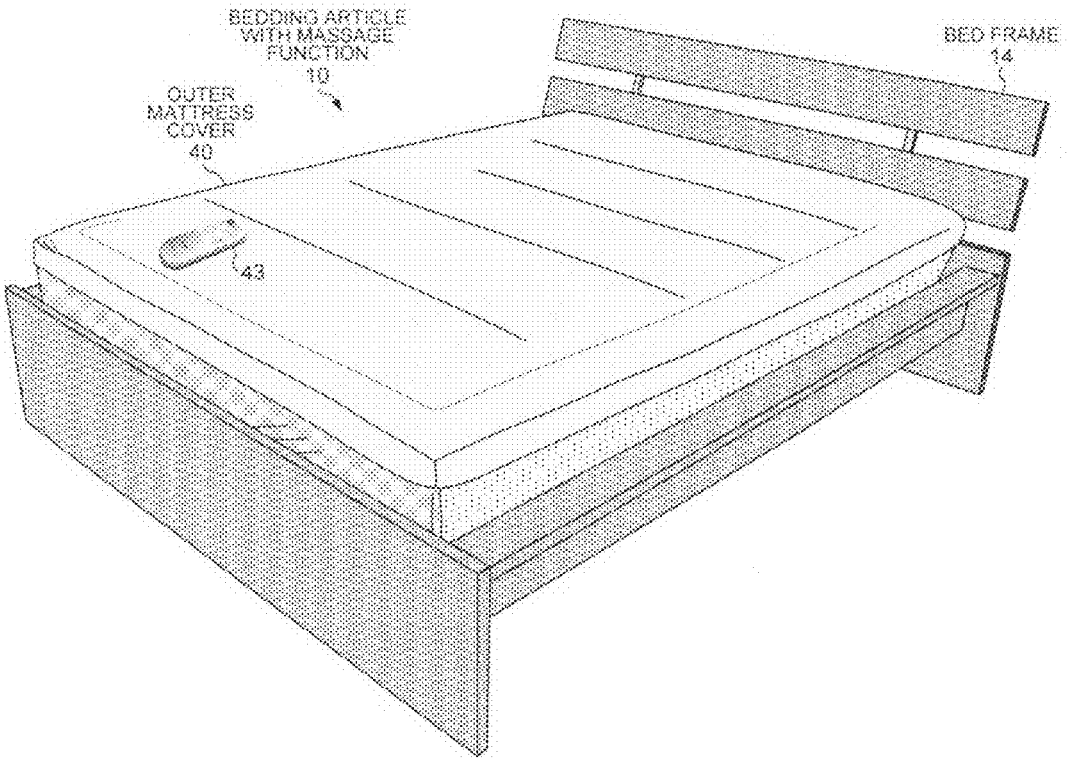
FIG. 10 is a perspective view of the bedding article of FIG. 1 ready for use by an end customer with a remote control device placed on the mattress.

FIG. 10 shows bedding article 10 ready for use by the end customer. Mattress 11 has been flipped right side up, and the power cables 35 have been plugged into wall sockets. A remote control device 43 is shown at the foot of the left side of mattress 11. Remote control device 43 controls the massage motors of the massage modules 24-26 that occupy the cavities in the left side of bottom foam layer 15.

Figure 11:
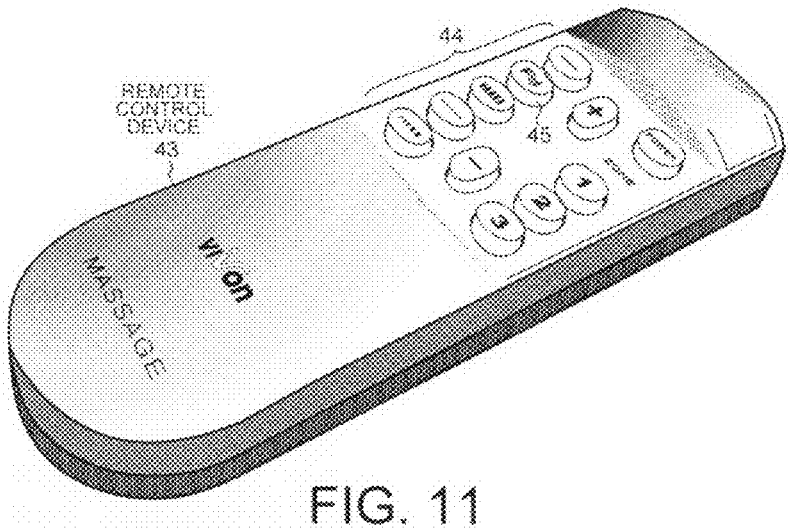
FIG. 11 is a more detailed view of the remote control device of FIG. 10.

FIG. 11 is a more detailed view of remote control device 43 of FIG. 10. Remote control device 43 has buttons "1", "2" and "3" that turn on the electric motors in massage modules 24-26, respectively. The "+" and "–" buttons increase and decrease the vibration of the massage modules. And the massage style buttons 44 on the left of remote control device 43 control how the massage modules work together. For example, the "wave" button 45 causes the most intense vibration of the massage modules to fluctuate among the positions, such as in the order 1-2-3-2-1-2-3 etc.

If one of the massage modules 24-26 and 37-39 should cease to function properly, the entire mattress 11 need not be returned to the manufacturer for repair. And a repairman also need not visit the end customer. The end customer can simply remove the damaged massage module and insert a replacement module delivered in the mail from the manufacturer. The replacement massage module is delivered with a power cord 31 that is plugged into the appropriate socket on the module controller from where the power cord of the damaged module was unplugged.

Figure 12:
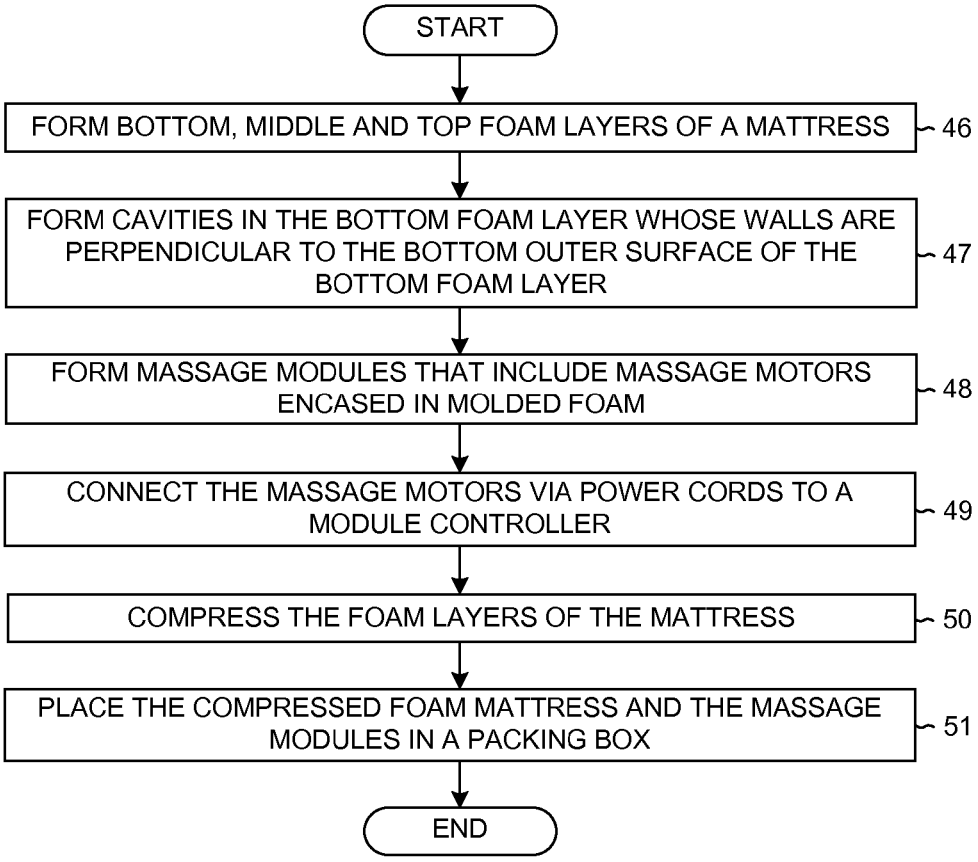
FIG. 12 is a flowchart of steps of a method of making the novel bedding article of FIG. 1.

FIG. 12 is a flowchart illustrating steps 46-51 of a method of making novel bedding article 10 that enables a mattress with a massage function to be shipped in a compressed condition. In a first step 46, three foam layers are formed. Bottom foam layer 15 and middle foam layer 16 are both made from HD foam having a density between 1.5 to 2.5 pounds per cubic foot. The top foam layer is made from memory foam having a density between three and 5.5 pounds per cubic foot.

In step 47, cavities are formed in bottom foam layer 15 with walls that are perpendicular to the bottom outer surface 17 of bottom foam layer 15. The shape formed by the walls of each cavity is the same as the shape of the hole through which the cavity opens to the bottom outer surface 17. Vertical holes are then punched in middle foam layer 16. The three foam layers are then glued together. Alternatively, middle foam layer 16 is glued to bottom foam layer 15, and then the memory foam layer is molded over the top of middle foam layer 16.

In step 48, the massage modules 24-26 and 37-39 are formed by attaching molded foam over a foam section on which a massage motor is placed. The molded foam encases the massage motor. The foam section has a plurality of cylindrical holes that are orthogonal to the top and bottom sides of the foam section, which have the shape formed by the walls of the cavities 21. Consequently, the top and bottom sides of each massage module also have the shape formed by the walls of the cavities 21.

In step 49, the massage motors 28 in each massage module 12 are connected via power cords 31 to a module controller 27. Massage modules 24-27 are connected to massage controller 27, whereas massage modules 37-39 are connected to a second massage controller. The massage controllers are adapted to receive radio frequency signals from the remote control devices.

In step 50, thin mattress cover 18 is pulled over the three glued foam layers to form mattress 11. The foam layers and mattress cover 18 are then inserted into plastic bag 13 and compressed. While mattress 11 is compressed, air-tight plastic bag 13 is sealed to prevent air from entering the bag.

In step 51, compressed mattress 11 is folded and then rolled up. Then the compressed and rolled mattress 11, the massage modules, the massage controllers, the outer mattress cover and the remote control devices are placed in a packing box. Alternatively, the compressed foam layers of mattress 11 are placed in a first packing box, and the massage modules 24-26 and 37-39, the module controllers 34, the outer mattress cover 40 and the remote control devices 43 are placed in a second packing box that is shipped along with the first packing box. When the end customer receives the packing box, the customer decompresses the mattress and inserts the massage modules into the cavities in the foam mattress.

The three foam layers of novel bedding article 10 are described above as forming mattress 11. In another embodiment, the pieces of cut foam 32 beneath the massage motors as well as the middle and top foam layers are made thinner. The three thinner foam layers then form a mattress topper that fits over a used mattress of the end customer. In this embodiment, outer mattress cover 40 is made large enough to fit around the mattress topper as well as the used mattress. The antenna cables 36 do not hang out the bottom as with mattress 11, but rather are extended inside the outer mattress cover 40 at the edges between the topper and the used mattress. The compressed mattress topper and the massage modules can be shipped in a single packing box.

Although certain specific embodiments are described above for instructional purposes, the teachings of this patent document have general applicability and are not limited to the specific embodiments described above. Although mattress 11 is described above as being a queen size mattress, novel bedding article 10 can be adapted to any sized mattress. Queen and king size mattresses have three massage modules on both the right and left sides of the mattresses. Twin (single) and full size mattresses have just three massage modules. Although mattress 11 is described above as having three foam layers, novel bedding article 10 can have just two foam layers: bottom layer 15 and middle layer 16. Mattress 11 can also have more than three layers. Although mattress 11 is described as having only foam layers, mattress 11 can also have a layer of pocket springs. Bottom foam layer 15 can be attached to a middle layer of foam-encased pocket springs. Then a layer of memory foam is molded over the middle layer of pocket springs. Accordingly, various modifications, adaptations, and combinations of various features of the described embodiments can be practiced without departing from the scope of the invention as set forth in the claims.

What is claimed is:

1. An article comprising:

a foam layer with an outer surface, wherein a cavity in the foam layer has walls that are perpendicular to the outer surface, wherein the walls of the cavity form a shape, and wherein the cavity opens through a hole in the outer surface that has the shape; and a massage module that occupies the cavity in the foam layer, wherein the massage module includes a massage motor encased in molded foam, and wherein a first side of the massage module has the shape.

2. The article of claim 1, wherein the outer surface of the foam layer and the first side of the massage module are coplanar.

3. The article of claim 1, wherein the outer surface of the foam layer is a bottom surface of a mattress.

4. The article of claim 1, wherein the foam layer is part of a mattress topper.

5. The article of claim 1, further comprising:

a module controller that is connected to the massage module by a cord.

6. The article of claim 5, wherein the module controller is adapted to receive a radio frequency signal from a remote control device.

7. The article of claim 1, wherein the massage module is replaceable.

8. The article of claim 1, further comprising:

a second foam layer that is glued to the foam layer with the cavity.

9. A method comprising:

forming a cavity in a foam layer, wherein the cavity has walls that are perpendicular to an outer surface of the foam layer, wherein the walls of the cavity form a shape, and wherein the cavity opens through a hole in the outer surface that has the shape; and forming a massage module that includes a massage motor encased in molded foam, wherein a first side of the massage module has the shape.

10. The method of claim 9, further comprising:

compressing the foam layer in a bag; and sealing the bag to prevent air from entering the bag.

11. The method of claim 10, further comprising:

placing the compressed foam layer and the massage module in a packing box.

12. The method of claim 9, wherein the foam layer is part of a mattress topper.

13. The method of claim 9, wherein the foam layer is part of a mattress.

14. The method of claim 9, further comprising:

connecting the massage motor via a cord to a controller, wherein the controller is adapted to receive a radio frequency signal.

15. A method comprising:

forming a cavity in a foam layer, wherein the cavity has walls that are perpendicular to an outer surface of the foam layer, wherein the walls of the cavity form a shape, and wherein the cavity opens through a hole in the outer surface that has the shape;

forming a massage module that includes a massage motor encased in molded foam, wherein a first side of the massage module has the shape;

inserting a foam plug into the cavity; and compressing the foam layer with the foam plug inserted into the cavity.

16. A method comprising:

forming a cavity in a foam layer, wherein the cavity has walls that are perpendicular to an outer surface of the foam layer, wherein the walls of the cavity form a shape, and wherein the cavity opens through a hole in the outer surface that has the shape; and forming a massage module that includes a massage motor encased in molded foam, wherein a first side of the massage module has the shape, and wherein the massage module has a plurality of cylindrical holes that are orthogonal to the first side.

17. The method of claim 16, wherein the step of forming the massage module includes attaching the molded foam to a foam section having the plurality of cylindrical holes.

18. An article comprising:

a massage module that includes a massage motor encased in molded foam, wherein a first side of the massage module has a shape;

a foam layer; and means for receiving the massage module into the foam layer, wherein the means exhibits the shape.

19. The article of claim 18, wherein the means has walls that are perpendicular to an outer surface of the foam layer, and wherein the walls form the shape.

20. The article of claim 18, wherein the foam layer is part of a mattress.

21. An article comprising:

a foam layer with an outer surface, wherein a cavity in the foam layer has walls that are perpendicular to the outer surface, wherein the walls of the cavity form a shape, and wherein the cavity opens through a hole in the outer surface that has the shape; and a massage module that occupies the cavity in the foam layer, wherein the massage module includes a massage motor encased in molded foam, wherein a first side of the massage module has the shape, and wherein the massage module has a plurality of cylindrical holes that are orthogonal to the first side.

* * * * *